US009121599B2

(12) United States Patent
Hung

(10) Patent No.: US 9,121,599 B2
(45) Date of Patent: Sep. 1, 2015

(54) STRUCTURE OF OUTDOOR ILLUMINATING DEVICE

(71) Applicant: SHUNCHI TECHNOLOGY CO., LTD., Taichung (TW)

(72) Inventor: You-Nan Hung, Taichung (TW)

(73) Assignee: Shunchi Technology Co., Ltd., Taichung (TW)

( * ) Notice: Subject to any disclaimer, the term of this patent is extended or adjusted under 35 U.S.C. 154(b) by 338 days.

(21) Appl. No.: 13/859,064

(22) Filed: Apr. 9, 2013

(65) Prior Publication Data

US 2014/0301079 A1 Oct. 9, 2014

(51) Int. Cl.

| | |
|---|---|
| ***F21V 31/00*** | (2006.01) |
| ***F21K 99/00*** | (2010.01) |
| *F21W 111/02* | (2006.01) |
| *F21Y 101/02* | (2006.01) |

(52) U.S. Cl.

CPC ..... *F21V 31/005* (2013.01); *F21K 9/30* (2013.01); *F21W 2111/02* (2013.01); *F21Y 2101/02* (2013.01)

(58) Field of Classification Search

CPC ..... F21V 31/005; F21W 2111/02

USPC ..... 362/146, 147, 249.01, 373

See application file for complete search history.

(56) References Cited

U.S. PATENT DOCUMENTS 8,016,453 B2 * 9/2011 Xiao et al. ..... 362/247

* cited by examiner

*Primary Examiner* — David V Bruce

(74) *Attorney, Agent, or Firm* — Rosenberg, Klein & Lee

(57) ABSTRACT

A structure of an outdoor illuminating device has a lamp housing disposed on a substrate. The light-emitting element of a light source module is disposed under the substrate. The heat sink of the light source module is interposed between the substrate and the lamp housing. A transparent mask covers the substrate from below, and is fixed to the substrate by a fastening element, thereby forming a closed chamber that prevents moisture from entering. The light-emitting element is inside the chamber, and the heat sink is outside the chamber.

8 Claims, 5 Drawing Sheets

STRUCTURE OF OUTDOOR ILLUMINATING DEVICE

BACKGROUND OF THE INVENTION

1. Field of Invention

The invention relates to an illuminating device and, in particular, to an outdoor illuminating device.

2. Related Art

ROC Pat. No. M364181 disclosed an "LED lamp and the closed cooling device thereof". In the prior art, the LED lamp (as shown in FIG. 1) is susceptible to dusts and moisture that enter via the cooling holes of the lamp housing. They stay and accumulate inside the LED module, heat homogenizer, or heat sink fins, covering the heat-dissipating area and affecting the cooling efficiency of the LED lamp.

Therefore, the above-mentioned patent has the heat sink attached to the inner wall of the lamp housing. The surfaces of the heat sink and the lamp housing enable fast heat dissipation to increase the heat-dissipating efficiency. In comparison with the prior art, it can avoid the problem of dust accumulation on the surfaces of the heat homogenizer and the heat sink fins and thus the worse heat-dissipating efficiency.

Although the closed space formed by the lamp housing, the frame, and the heat conductive board can maintain the cleanness inside the lamp and prevent dusts and moisture from entering, the lamp housing in fact still has the problem of bad cooling due to the lack of air circulation. Once the LED module is turned on and emits light, the heat is transferred by a heat pipe to the fins, a heat conductive medium, and the lamp housing. Nevertheless, the heat is completely kept inside the lamp housing due to the closed space. The heat exchange with the environment relies completely on the lamp housing. In addition to an extremely hot lamp housing, the heat sink fins also lose their functions. In the end, the LED modules still operate under high temperature and are likely to break down.

It is a primary goal of the invention to solve the above-mentioned problem that waterproof and heat dissipation cannot be obtained at the same time in the conventional illuminating devices.

SUMMARY OF THE INVENTION

An objective of the invention is to provide a structure for an outdoor illuminating device, whose light-emitting element of the light source module has a good waterproof effect. The heat sink of the light source module has a good heat-dissipating effect, so that both waterproof and heat dissipation can be obtained at the same time.

To achieve the above-mentioned objective, the invention includes:

a substrate having a plurality of through holes;

a lamp housing disposed on the substrate and having a plurality of cooling holes;

a plurality of light source modules, each of which includes a light-emitting element under the substrate and a heat sink between the substrate and the lamp housing, with one of the light-emitting element and the heat sink going through a corresponding through hole on the substrate to connect to the other and to be fixed onto the substrate;

a transparent mask covering the substrate under the substrate and fixed onto the substrate via at least one fastening element, thereby forming a closed chamber that can prevent moisture from entering; wherein the light-emitting element is inside the chamber and the heat sink is outside the chamber.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
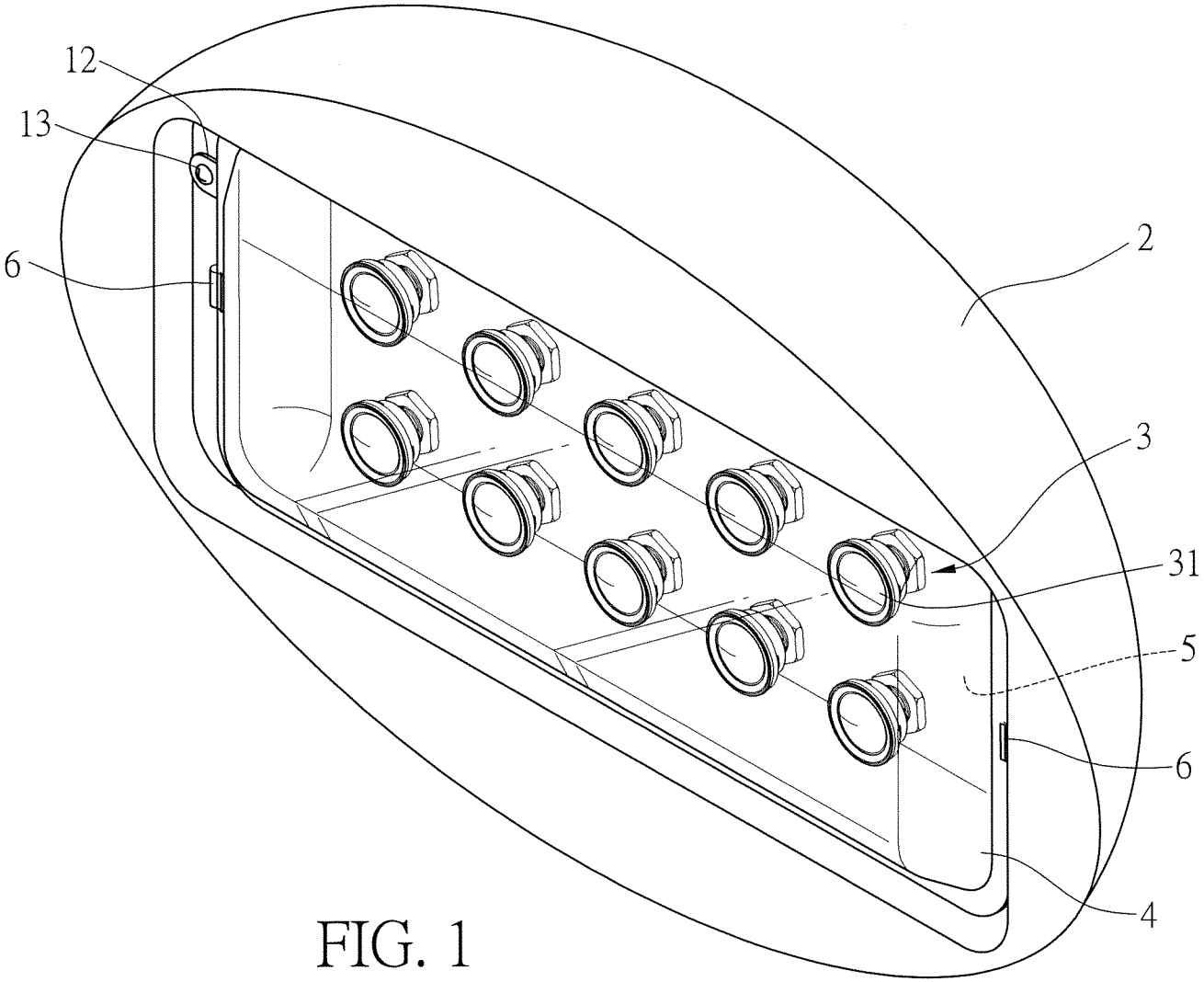
FIG. 1 is a three-dimensional perspective view of the invention.
Figure 2:
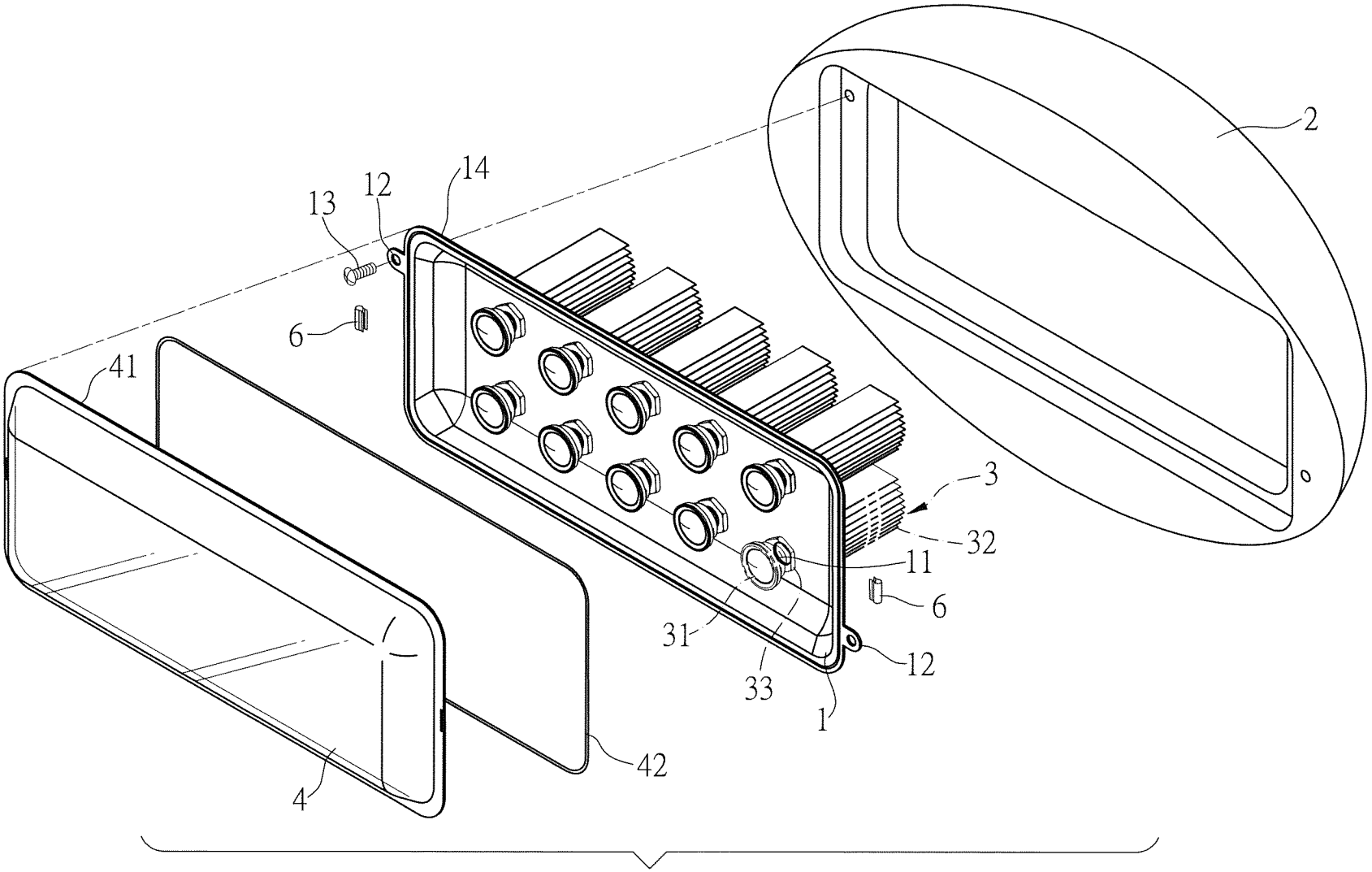
FIG. 2 is a three-dimensional exploded view of the invention.
Figure 3:
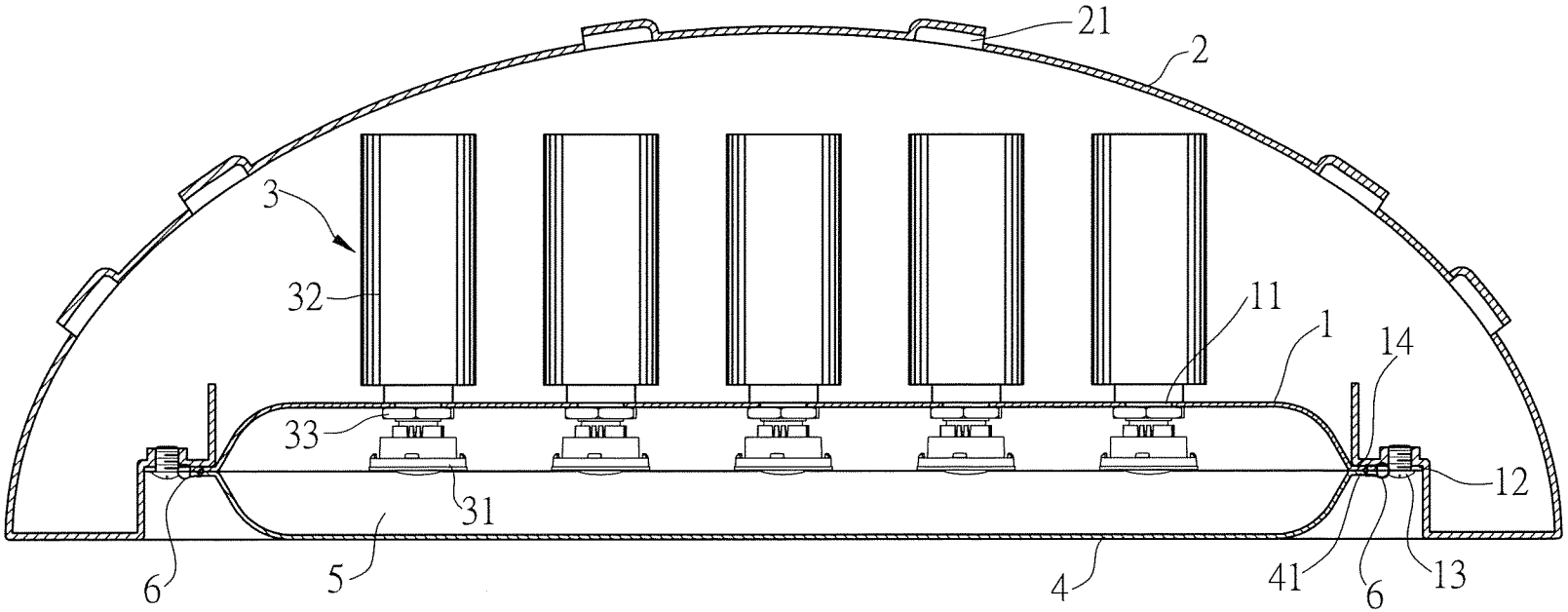
FIG. 3 is a cross-sectional view of the invention.

An embodiment of the invention has the structure of an outdoor illuminating device as shown in FIGS. 1 to 3. It includes a substrate 1, a lamp housing 2, ten light source modules 3, and a transparent mask 4.

As FIGS. 2 and 3 show, the substrate 1 in this embodiment has ten through holes 11. Each of the through holes 11 allows the installation of a light source module 3. The lamp housing 2 is disposed on the substrate 1, and has several cooling holes 21. In this embodiment, the two opposite sides of the substrate 1 have ear parts 12, respectively. Two fixing screws 13 go through the two ear parts 12, respectively, to fix the substrate 1 onto the lamp housing 2. The lamp housing 2 in this embodiment has an elliptic shape, while the substrate 1 has a long rectangular shape.

As shown in FIGS. 2 and 3, each of the light source modules 3 includes a light-emitting element 31 and a heat sink 32. The light-emitting element 31 is under the substrate 1. The heat sink 32 is disposed on the substrate 1. The heat sink 32 is interposed between the substrate 1 and the lamp housing 2. One of the light-emitting element 31 and the heat sink 32 goes through the corresponding through hole 11 of the substrate 1 to connect to the other and to be fixed onto the substrate 1.

As shown in FIGS. 2 and 3, the transparent mask 4 covers the substrate 1 under the substrate 1. At least one fastening element fixes the transparent mask 4 to the substrate 1, forming a waterproof closed chamber 5. The light-emitting element 31 is inside the chamber 5, while the heat sink 32 is outside the chamber 5.

Figure 4:
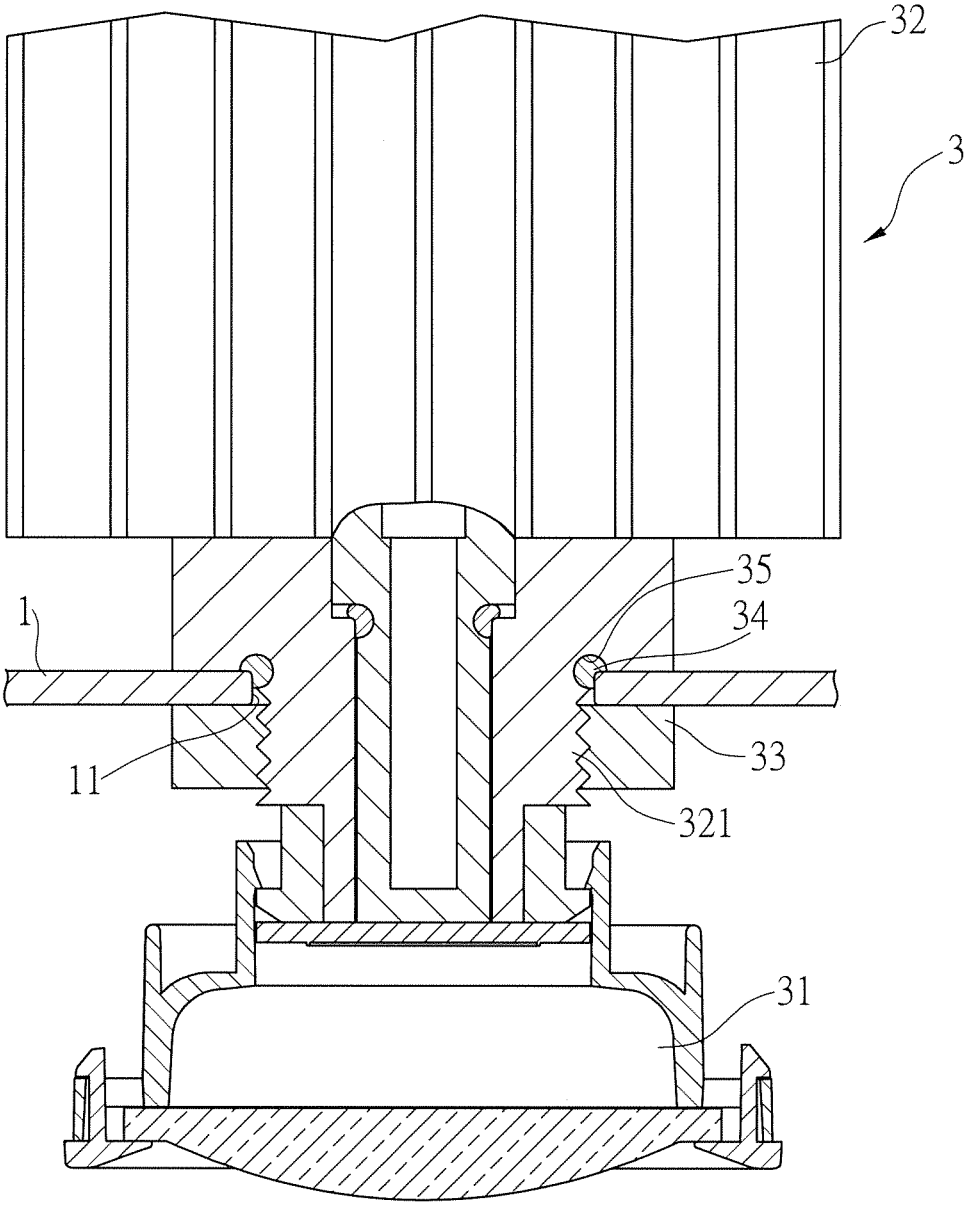
FIG. 4 is a cross-sectional view of the light source module mounted on the substrate via through holes.

As FIGS. 3 and 4 show, the heat sink 32 of each individual light source 3 has a connecting part 321 going through a through hole 11. The connecting part 321 in this embodiment is an external thread part. A fixing element 33 is connected to the connecting part 321 under the substrate 1, thereby fixing the heat sink 32 onto the substrate 1. The fixing element 33 in this embodiment is a nut corresponding to the connecting part 321. A sealing ring 34 is mounted between the connecting part 321 and the substrate 1. The sealing ring 34 is sandwiched between the heat sink 32 and the substrate 1 to prevent moisture from entering the chamber 5 via the through holes 11. Moreover, in this embodiment the connecting part 321 has an annular recess 35 at the place for mounting the sealing ring 34. The annular recess 35 helps positioning the sealing ring 34 at the place thereof.

Figure 5:
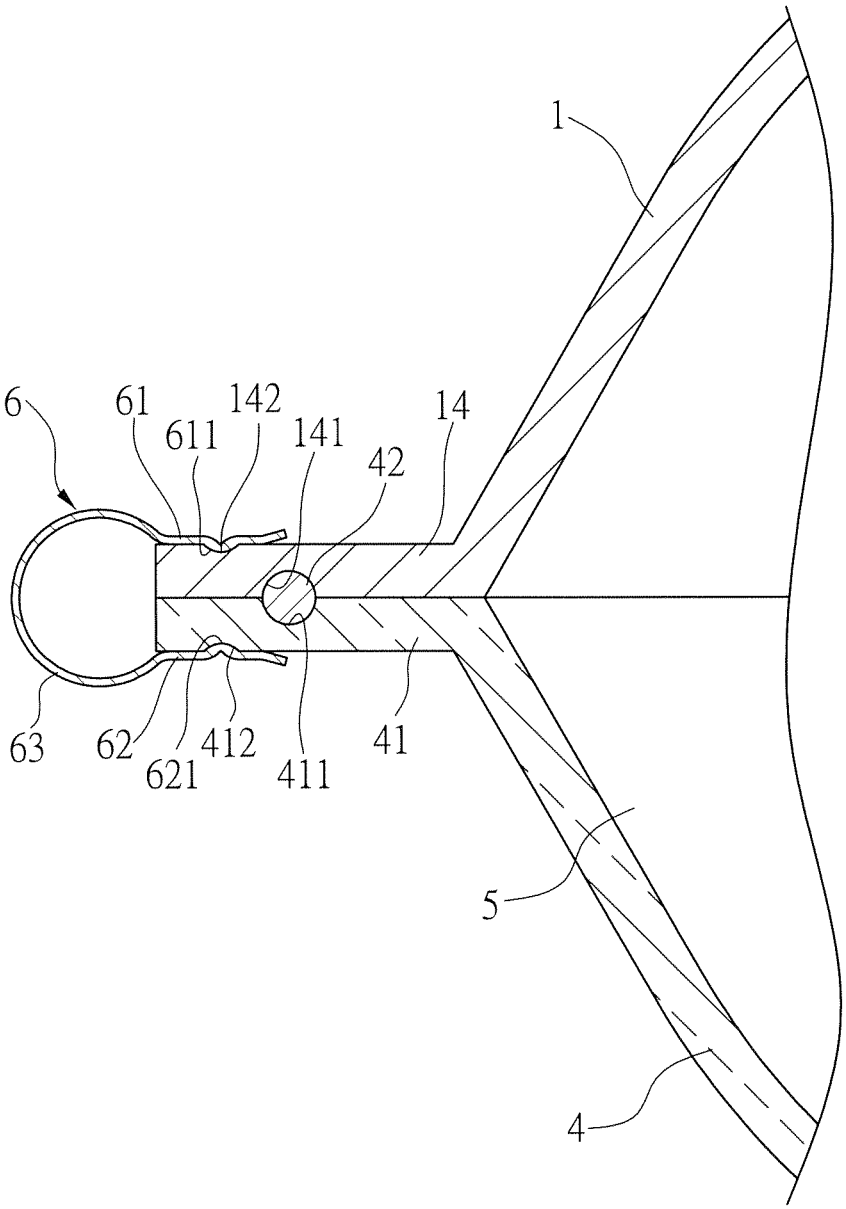
FIG. 5 is a local cross-sectional view of positioning the transparent mask on the substrate using a fastening element.

As shown in FIGS. 3 and 5, the substrate 1 has an upper lip part 14 extending horizontally from the rim thereof. The upper lip part 14 has a down-facing upper ring groove 141 around it. The transparent mask 4 has a lower lip part 41 extending horizontally from the rim thereof The lower lip part 41 has an up-facing lower groove 411 corresponding to the upper ring groove 141. The lower lip part 41 and the upper lip part 14 are correspondingly attached together. A sealing ring 42 is sandwiched between the upper ring groove 141 and the lower groove 411, preventing moisture from entering the chamber 5 between the upper ring groove 141 and the lower groove 411.

For the transparent mask 4 shown in FIGS. 2 and 3, the two opposite sides thereof are fixed to the substrate 1 by a fastening element, respectively. Each of the fastening elements is a clip 6. The clip 6, as shown in FIG. 5, has an upper clipping part 61 and a lower clipping part 62 connected on one side by a connecting part 63. The upper clipping part 61 has an upper protruding part 611 protruding toward the lower clipping part 62. The lower clipping part 62 has a lower protruding part 621 protruding toward the upper clipping part 61. The upper lip part 14 has an upper recess 142 to block the upper protruding part 611. The lower lip part 41 has a lower recess 412 to block the lower protruding part 621. The upper protruding part 611 and the lower protruding part 621 are trapped and blocked by the upper recess 142 and the lower recess 412, so that the clip 6 gets positioned on both sides of the transparent mask 4, thereby fixing the transparent mask 4 and the substrate 1.

The advantages of the invention are the following. The substrate 1 and the transparent mask 4 are fixed by a fastening element. In this embodiment, the sealing ring 34 and the sealing ring 42 completely seal possible places for moisture to enter the chamber 5. The chamber 5 is thus completely closed, providing good waterproof effect for the light-emitting element 31 of the light source module 3. At the same time, the heat sink 32 of the light source module 3 is outside the chamber 5 and under the lamp housing 2. The lamp housing 2 has cooling holes 21, instead of being completely sealed. Even if moisture enters the lamp housing 2, the light-emitting element 31 is still free from the moisture as it is inside the sealed chamber 5. Therefore, the circuit of the light-emitting element 31 will not be damaged by moisture. As a result, the light-emitting element has a good waterproof effect, and the heat sink has a good heat-dissipating effect.

It is worth mentioning that when the shape of the lamp housing 2 is changed to a different geometrical shape, such as a circle or square, the shape of the substrate 1 can be changed accordingly. Likewise, a fixing screw 13 goes through the two ear parts 12 to fix the substrate 1 and the lamp housing 2. Thus, the assembly of the substrate 1 and the lamp housing 2 is fairly convenient even when their shapes are changed.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A structure of an outdoor illuminating device, comprising:

a substrate having at least one through hole;

a lamp housing disposed on the substrate and having cooling holes;

a plurality of light source modules, each of which includes one light-emitting element under the substrate and one heat sink interposed between the substrate and the lamp housing, wherein one of the light-emitting element and the heat sink goes through the corresponding through hole on the substrate to connect to the other and to be fixed onto the substrate;

a transparent mask covering the substrate under the substrate and fixed onto the substrate by a fastening element, thereby forming a sealed chamber to prevent moisture from entering, wherein the light-emitting element is inside the chamber and the heat sink is outside the chamber.

2. The structure of an outdoor illuminating device according to claim 1, wherein the substrate has an upper lip part extending horizontally along the rim thereof, the upper lip part is formed with a down-facing upper ring groove, the transparent mask has a lower lip part extending horizontally along the rim thereof, the lower lip part has an up-facing lower groove corresponding to the upper ring groove, the lower lip part and the upper lip part correspondingly attach together, a sealing ring is interposed between the upper ring groove and the lower groove to prevent moisture from entering the chamber between the upper lip part and the lower lip part.

3. The structure of an outdoor illuminating device according to claim 2, wherein the two opposite sides of the substrate are provided with ear parts, two fixing screws go through the two ear parts to fix the substrate to the lamp housing.

4. The structure of an outdoor illuminating device according to claim 2, wherein the two opposite sides of the transparent mask are fixed to the substrate by a fastening element, respectively.

5. The structure of an outdoor illuminating device according to claim 4, wherein each of the fastening elements is a clip having an upper clipping part and a lower clipping part connected by a connecting part on one side, the upper clipping part has an upper protruding part protruding toward the lower clipping part, the lower clipping part has a lower protruding part protruding toward the upper clipping part, the upper lip part has an upper recess to block the upper protruding part, and the lower lip part has a lower recess to block the lower protruding part.

6. The structure of an outdoor illuminating device according to claim 1, wherein the heat sink of each of the light source modules has a connecting part going through the corresponding through hole, a fixing element is fixed to the connecting part under the substrate to fix the heat sink onto the substrate, the connecting part is mounted with a sealing ring on the substrate, the sealing ring is sandwiched between the heat sink and the substrate to prevent moisture from penetrating into the chamber via the through holes.

7. The structure of an outdoor illuminating device according to claim 6, wherein the connecting part has an annular recess for positioning the sealing ring.

8. The structure of an outdoor illuminating device according to claim 6, wherein the connecting part is an outer thread part and the fixing element is a nut for the connection with the connecting part.

* * * * *